US009171519B2

(12) United States Patent
Liu et al.

(10) Patent No.: US 9,171,519 B2
(45) Date of Patent: Oct. 27, 2015

(54) METHOD AND DEVICE FOR DRIVING LIQUID CRYSTAL DISPLAY PANEL AND LIQUID CRYSTAL DISPLAY

(71) Applicants: BOE TECHNOLOGY GROUP CO., LTD., Beijing (CN); HEFEI BOE OPTOELECTRONICS TECHNOLOGY CO., LTD., Hefei (CN)

(72) Inventors: Xiaopeng Liu, Beijing (CN); Yongjun Yoon, Beijing (CN); Yanping Zhang, Beijing (CN); Hengbin Li, Beijing (CN); Shanshan Huang, Beijing (CN)

(73) Assignees: BOE Technology Group Co., Ltd., Beijing (CN); Hefei BOE Optoelectronics Technology Co., Ltd., Beijing (CN)

( * ) Notice: Subject to any disclaimer, the term of this patent is extended or adjusted under 35 U.S.C. 154(b) by 138 days.

(21) Appl. No.: 14/128,062

(22) PCT Filed: Nov. 6, 2012

(86) PCT No.: PCT/CN2012/084169

§ 371 (c)(1),
(2) Date: Dec. 20, 2013

(87) PCT Pub. No.: WO2013/170591

PCT Pub. Date: Nov. 21, 2013

(65) Prior Publication Data

US 2014/0118320 A1 May 1, 2014

(30) Foreign Application Priority Data

May 14, 2012 (CN) ..... 2012 1 0149612

(51) Int. Cl.
*G09G 3/36* (2006.01)

(52) U.S. Cl.
CPC ..... *G09G 3/3696* (2013.01); *G09G 3/3648* (2013.01); *G09G 2320/0252* (2013.01)

(58) Field of Classification Search
CPC combination set(s) only.
See application file for complete search history.

(56) References Cited

U.S. PATENT DOCUMENTS

2008/0043007 A1* 2/2008 Whight ..... 345/211

FOREIGN PATENT DOCUMENTS

CN 1897642 A 1/2007
CN 101014988 A 8/2007

(Continued)

OTHER PUBLICATIONS

First Office Action issued by the Chinese Patent Office for Chinese Patent Application No. 201210149612.8 dated Aug. 5, 2013, 6pgs.

(Continued)

*Primary Examiner* — Dwayne Bost
*Assistant Examiner* — Robert Michaud

(57) ABSTRACT

A method for driving a liquid crystal display panel (61), a driving device (50), and a liquid crystal display (60). The method for driving a liquid crystal display panel (61) comprises: compensating for voltages of data lines according to pixel values of pixels on the liquid crystal display panel (61) that correspond to an image to be displayed; and inputting the voltages of the data lines after compensation to the data lines to drive the liquid crystal display panel (61) for display. Such a driving method is capable of reducing charging and discharging time for pixel electrodes and improving the display quality of a liquid crystal display.

6 Claims, 3 Drawing Sheets

(56) References Cited

FOREIGN PATENT DOCUMENTS

| | | | |
|---|---|---|---|
| CN | 101399013 | A | 4/2009 |
| CN | 101609653 | A | 12/2009 |
| CN | 102024440 | A | 4/2011 |
| CN | 102708820 | A | 10/2012 |

OTHER PUBLICATIONS

English translation of First Office Action issued by the Chinese Patent Office for Chinese Patent Application No. 201210149612.8 dated Mar. 13, 2014, 6pgs.

Second Office Action issued by the Chinese Patent Office for Chinese Patent Application No. 201210149612.8 dated Mar. 13, 2014, 5pgs.

English translation of Second Office Action issued by the Chinese Patent Office for Chinese Patent Application No. 201210149612.8 dated Mar. 13, 2014, 3pgs.

English Language Abstract of CN10202440 A; 1 page, Jun. 26, 2015.

PCT Written Opinion of the International Search Authority for PCT/CN2012/084119 (Chinese language), mailed Feb. 28, 2013; 5 pages, Jun. 26, 2015.

English translation of PCT Written Opinion of the International Search Authority of Feb. 28, 2013 for PCT/CN2012/084119; 9 pages, Jun. 26, 2015.

* cited by examiner

METHOD AND DEVICE FOR DRIVING LIQUID CRYSTAL DISPLAY PANEL AND LIQUID CRYSTAL DISPLAY

CROSS REFERENCE TO RELATED APPLICATIONS

This application is based on International Application No. PCT/CN2012/084169 filed on Nov. 6, 2012, which claims priority to Chinese National Application No. 201210149612.8 filed on May 14, 2012, the contents of which are incorporated herein by reference.

TECHNICAL FIELD

The present invention relates to the field of liquid crystal display technology, in particular to a driving method for a Liquid Crystal Display (LCD) panel, an apparatus for the same and a liquid crystal display.

BACKGROUND

A liquid crystal display in the prior art includes a liquid crystal display panel, a source driving unit and a gate driving unit, wherein the gate driving unit gates corresponding pixels of the liquid crystal display panel according to an image to be displayed, the source driving unit converts display data of the received image to be displayed into data voltages, and data voltages are applied to the corresponding pixels on the liquid crystal display panel via data lines, so that a corresponding image is displayed.

The source driving unit transmits the converted data voltages to the data lines on the liquid crystal display panel according to the display data of the image to be displayed, so that the corresponding pixel electrodes can be charged or discharged. Generally, the voltages sent to the data lines by the source driving unit have certain rising edges or falling edges, which will shorten the time for charging the pixel electrodes, so that the pixel electrodes can not reach the corresponding grayscale brightness, which affects display quality of the liquid crystal display.

SUMMARY OF THE INVENTION

An embodiment of the present invention provides a driving method for a liquid crystal display panel and a driving apparatus for the same, to reduce the charging/discharging time of pixel electrodes.

Further, an embodiment of the present invention further provides a LCD comprising the driving apparatus for the LCD panel, which can improve display quality of the LCD.

To achieve the above purpose, the embodiments of the present invention adopt the following technical solution:

a driving method for a liquid crystal display panel comprising:

compensating a voltage on a data line according to a pixel value of each of pixels on the LCD panel corresponding to an image to be displayed; and inputting the compensated voltage on the data line to the data line, and driving the LCD panel for display.

A driving apparatus for a LCD panel, comprising a gate driving unit and a source driving unit, wherein the driving apparatus further comprises a compensating unit;

the compensating unit compensates a voltage on a data line according to a pixel value of each of pixels on the LCD panel corresponding to an image to be displayed;

the source driving unit inputs the voltage on the data line compensated by the compensating unit to the data line, and drives the LCD panel for display.

Further, an embodiment of the present invention adopts the following technical solution:

A liquid crystal display, comprising the driving device for the LCD panel described above.

The embodiments of the present invention provide a driving method for a liquid crystal display panel and a driving apparatus for the same, and a LCD, wherein the driving method for a liquid crystal display panel comprises: compensating a voltage on a data line according to a pixel value of each of pixels on the LCD panel corresponding to an image to be displayed; and inputting the compensated voltage on the data line to the LCD panel, and driving the LCD panel to display the image to be displayed. Since the voltage on the data line is compensated, the time for charging the pixel is shortened, thus improving the display quality of the LCD.

BRIEF DESCRIPTION OF THE DRAWINGS

In order to more clearly illustrate technical solutions in the embodiments of the invention or in the prior art, the accompanying drawings required for describing the embodiments or the prior art are introduced briefly hereinafter. Apparently, in the following description, the accompanying drawings only show some embodiments of the present invention, those ordinary skilled can also obtain other accompanying drawings based on these drawings without paying any inventive labor.

DETAILED DESCRIPTION OF THE PREFERRED EMBODIMENTS

Hereinafter, the technical solutions in the embodiments of the present invention will be described clearly and thoroughly with reference to the accompanying drawings of the embodiments. Obviously, the embodiments as described are only some of the embodiments of the present invention, and are not all of the embodiments of the present invention. All other embodiments obtained by those skilled in the art based on the embodiments in the present disclosure without paying any inventive labor would fall into the protection scope of the present invention.

Figure 1:
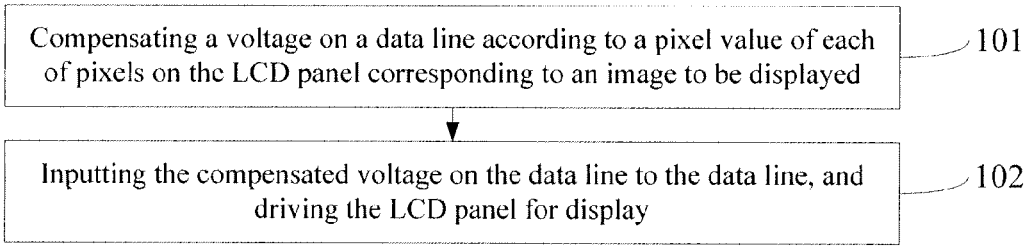
FIG. 1 is a schematic diagram showing a flow of a driving method for a liquid crystal display panel provided in an embodiment of the invention.

An embodiment of the present invention provides a driving method for a liquid crystal display panel, as shown in FIG. 1, comprising:

In step 101, compensating a voltage on a data line according to a pixel value of each of pixels on the LCD panel corresponding to an image to be displayed; and In step 102, inputting the compensated voltage on the data line to the data line, and driving the LCD panel for display.

Figure 2A:
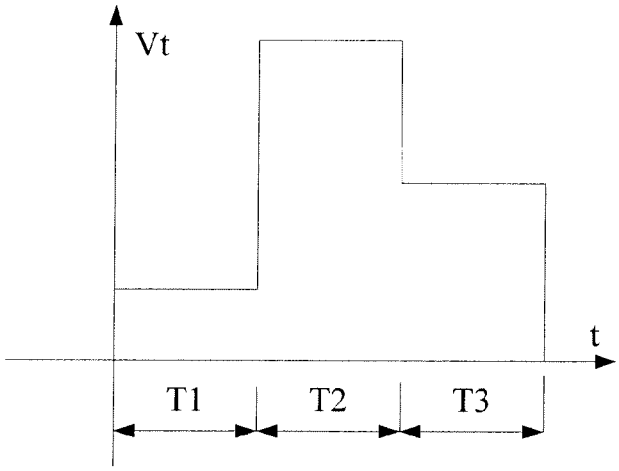
FIG. 2A is a schematic diagram showing a theoretical voltage transmitted to a data line by a source driving unit.
Figure 2B:
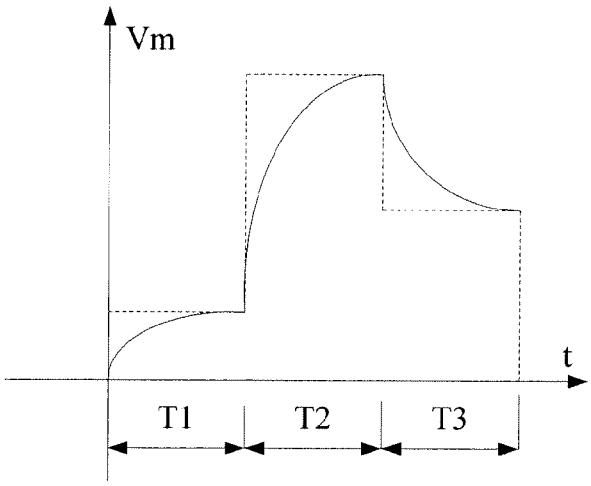
FIG. 2B is a schematic diagram showing an actual voltage transmitted to the data line by the source driving unit.

The display mode of the LCD is a type of maintaining, that is, the LCD maintains a certain picture during a time period. The liquid crystal display includes a liquid crystal display panel and a driving apparatus for the liquid crystal display panel, wherein the driving apparatus supplies a corresponding voltage to data lines corresponding to each of pixels based on a pixel value of each pixel corresponding to an image to be displayed, thereby driving the liquid crystal molecules to be rotated so as to display the image. For example, assuming that a pixel A has corresponding pixel values of 30, 220, and 100 in an image to be displayed at timings T1, T2, T3 respectively, a schematic diagram showing a theoretical voltage on the data line corresponding to the pixel A at timings T1, T2, and T3 is shown in FIG. 2A. However, in actual use, since the actual voltage input to the data line by the driving apparatus usually has a certain rising or falling edge, shown in FIG. 2B, as such, the voltage on the data line has a certain rising edge or falling edge, and there is a certain delay when the voltage on the data line for the pixel A reaches the theoretical voltage corresponding to the pixel value, resulting in the slow charging for the pixel A and in turn the problem of the ununiformility in a display picture of the liquid crystal display panel occurs. The embodiment of the present invention provides a technical solution to address the problem that it is slow for charging the pixel due to a certain rising-edge or falling-edge in the voltage on the data line in the prior art. When the driving method for the LCD panel provided in the present embodiment is employed, the voltage on the data line can be compensated in real-time in advance, so that the rising or falling time of the voltage on the data line can be shortened, thus shortening the time for charging the pixels on the liquid crystal display panel, and improving the display quality of the liquid crystal display panel.

Figure 3:
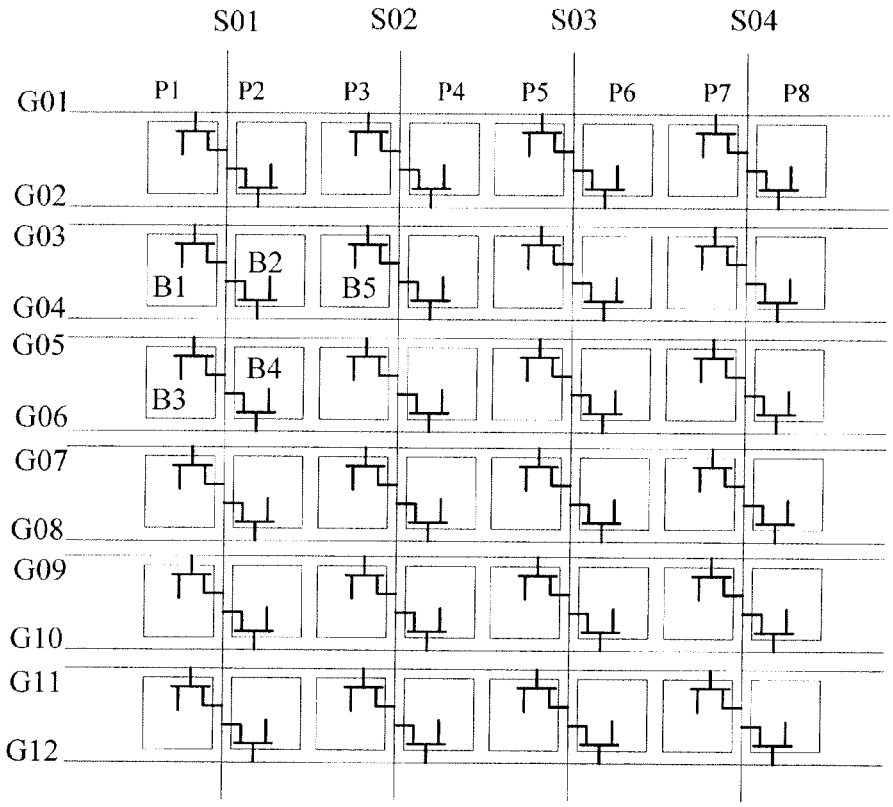
FIG. 3 is a schematic diagram showing a liquid crystal display panel with pixel architecture being as a HSD architecture.
Figure 4:
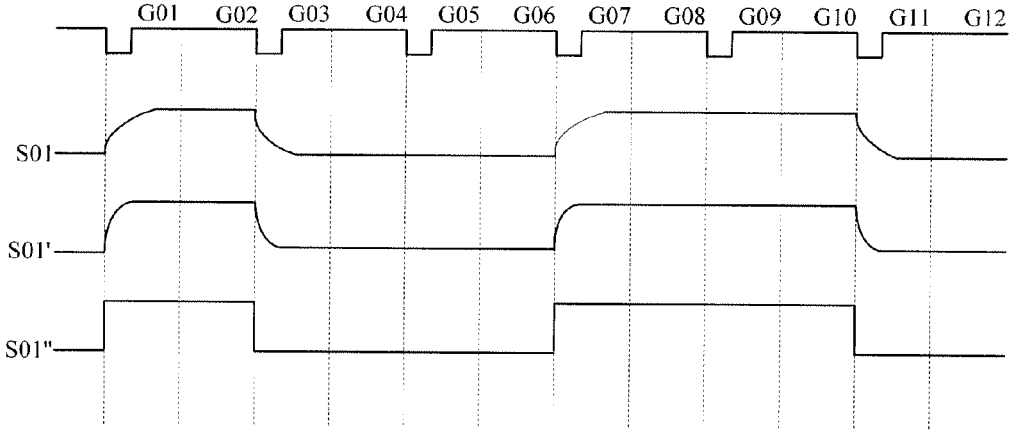
FIG. 4 is a schematic diagram showing a timing of a theoretical voltage, an actual voltage and a compensated voltage on a data line in the liquid crystal display panel with the HSD architecture adopting a double-line four-dot inversion driving technique.

Referring to FIG. 3, for example, pixel architecture of the liquid crystal display panel is of Half Source Driving (HSD) architecture. HSD architecture is referred to, compared with a conventional liquid crystal display panel, an architecture in which scanning lines are doubled and data lines are halved. That is, two adjacent columns of pixels on the LCD panel with HSD architecture share a same data line, as shown in FIG. 3, the data line S01 is shared by the column P1 of pixels and the column P2 of pixels, and the data line S02 is shared by the column P3 of pixels and the column P4 of pixels, the data line S03 is shared by the column P5 of pixels and the column P6 of pixels, and the data line S04 is shared by the column P7 of pixels and the column P8 of pixels. Every other columns of pixels share a same scanning line, and thus it is necessary to arrange two scanning lines for one row of pixels; as shown in FIG. 3, the pixels in the columns P1, P3, P5, P7 of pixels which are located in a first row of pixels share the scanning line G01, the pixels in the columns P2, P4, P6, P8 of pixels which are located in a first row of pixels share the scanning line G02. Naturally, the LCD panel comprises n scanning lines (G01, G02, . . . , Gn) and m data lines (S01, S02, . . . , Sn), and in FIG. 3, only a part of pixels on the LCD panel with HSD architecture are taken for illustration. The double-line four-dot inversion driving method can be applied to the LCD panel with HSD architecture, and the timing diagram of signals on scanning lines and data lines in the driving method is shown in FIG. 4; for example, it needs to scan two scanning lines G03 and G04 sequentially for four pixel dots B1, B2, B3 and B4, and to input a voltage to the data line S01. Since the driving method adopts a four-dot inversion, the voltage input to S01 maintains until the scanning lines G05 and G06 are gated. Then, when the scanning lines G07 and G08, G09 and G10 are gated sequentially respectively, the voltage input to S01 is inverted. Since the actual voltage on the data line S01 has a rising edge or a falling edge when the voltage is inverted, the pixel corresponding to the voltage on the data line having a rising edge or falling edge is charged slowly, for example, pixels B1, B5 and the like, so that the ununiformity occurs in display of the LCD panel. Similarly, a rising edge or falling edge is also generated in the voltage on data line S02 when the voltage is inverted. In view of the above, the driving method for the LCD panel provided in the embodiment of the present invention can compensate the voltage on the data line having a rising edge or falling edge in real time; referring to the schematic timing diagram S01' of the voltage on the data line S01 after being compensated in FIG. 4, it can be known that the issue of ununiformity in display of the LCD panel can be alleviated, wherein S01" represents a schematic timing diagram of the theoretical voltage on the data line S01.

Optionally, a set of compensating voltages is preset in the liquid crystal display, and the set of compensating voltages comprises values of compensating voltages of data lines corresponding to various pixel values of each of pixels on the LCD panel.

Further, compensating the voltage on the data line according to the pixel value of each of pixels on the LCD panel corresponding to the image to be displayed particularly comprises: acquiring the pixel value of each of pixels corresponding to the image to be displayed and the actual voltage supplied to the data line from the source driving unit; performing compensation according to the set of compensating voltages and the actual voltage on the data line.

Optionally, the set of compensating voltages preset in the LCD can comprise values of compensating voltages on the data lines corresponding to various pixel values of each of pixels preset in various LCDs according to test data, experiment values, or empirical values.

For example, assuming that the maximum pixel value of the pixels on the LCD panel is 255, and the theoretical voltage on the data line corresponding to the maximum pixel value of the pixel is 5V; provided that when the pixel value of the pixel obtained in a test is 255 and that the actual voltage on the data line obtained in the test is 4.4V, the value of the compensating voltage on the data line is 0.6V when the pixel has a pixel value of 255. Based on such a test, the compensating voltages corresponding to various pixel values of each of pixels on the LCD panel can be obtained in the test and preset in the LCD. Naturally, for the LCD panel with the HSD architecture shown in FIG. 3, it is necessary to only test and obtain the values of the compensating voltages for various pixel values of the pixel corresponding to the voltages on data lines having a rising edge or falling edge.

Optionally, the set of the compensating voltages preset in the LCD can also be a set comprising the product of the compensating voltage coefficients of each of pixels multiplied by each of pixel values of the pixel electrodes respectively, wherein the compensating voltage coefficient of each of pixels represents the quotient obtained from the difference value between the theoretical voltage on a data line and the actual voltage on the data line corresponding to a specific pixel value of each of pixels dividing the maximum pixel value of each of pixel.

For example, assuming that a specific pixel value of a pixel is 255 and that the theoretical voltage Vt and the actual voltage Vm on a data line corresponding to the pixel are 5V and 4.4V respectively, the compensating voltage coefficient of the pixel is 0.0024. Assuming that the pixel value of the pixel is 100 at a certain timing and that the actual voltage on the data line is 1.7V, since the compensating voltage on the data line is 0.24V, the compensated voltage on the data line corresponding to the pixel is 1.94V, thus to some extent compensating the voltage on the data line corresponding to the pixel.

Optionally, a specific pixel value in the set of compensating voltages obtained can be any pixel value of a pixel; if the maximum pixel value of the pixel is 255, the specific pixel value can be any pixel value between 0 and 255.

Since the voltage on the data lines corresponding to various pixel values of the pixel is non-linear, in order to minimize the deviation between the compensated voltage on the data line and the theoretical voltage on the data line, it is preferred that the specific pixel value is the maximum pixel value of the pixel.

The driving method for the liquid crystal display panel provided in the embodiment of the present invention comprises: compensating a voltage on a data line according to a pixel value of each of pixels on the LCD panel corresponding to an image to be displayed; and inputting the compensated data voltage to the data line, and driving the LCD panel for display, thereby reducing the time of the rising edge for the voltage input to the data line reaching the theoretical voltage corresponding to the pixel, shortening the charging time of the pixel, and further alleviating the problem of ununiformity of the display on the liquid crystal display in display and improving the display quality of LCD.

Figure 5:
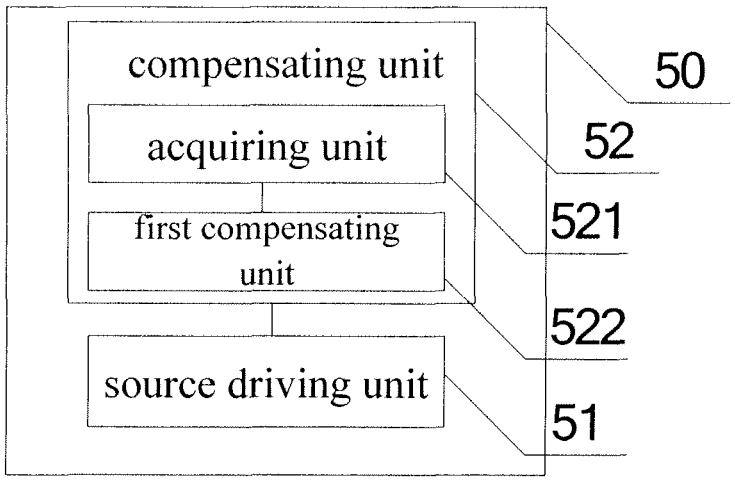
FIG. 5 is a schematic diagram illustrating a structure of a driving apparatus for a liquid crystal display panel provided in an embodiment of the present invention.

As shown in FIG. 5, an embodiment of the present invention further provides a driving apparatus for a LCD panel, the apparatus comprising a source driving unit 51 and a compensating unit 52.

The compensating unit 52 compensates a voltage on a data line according to a pixel value of each of pixels on the LCD panel corresponding to an image to be displayed; wherein the compensating unit 52 can be realized in FPGA.

The source driving unit 51 inputs the voltage on the data line compensated by the compensating unit 52 to the data line, and drives the LCD panel for display.

Optionally, the compensating unit 52 particularly includes: an aquisition module 521 and a first compensating module 522.

The acquisition module 521 acquires the pixel value of each of pixels corresponding to the image to be displayed and the actual voltage supplied to the data line from the source driving unit.

The first compensation module 522 performs compensation according to the set of compensating voltages as preset and the actual voltage on the data line, wherein the set of compensating voltages is a preset set of compensating voltages of data lines corresponding to various pixel values of each of pixels on the LCD panel.

Wherein, the preset set of compensating voltages are sets of values of compensating voltages of data lines corresponding to various pixel values of each of pixels on the LCD panel.

Optionally, the preset set of compensating voltages can be values of compensating voltages on the data lines corresponding to various pixel values of each of pixels on various LCDs according to test data, experiment values, or empirical values.

For example, assuming that the maximum pixel value of the pixels on the LCD panel is 255, and the theoretical voltage on the data line corresponding to the maximum pixel value of the pixel is 5V; when the pixel value of the pixel obtained in a test is 255, provided that the actual voltage on the data line obtained is 4.4V, the value of the compensating voltage on the data line is 0.6V when the pixel has a pixel value of 255. Based on such a test, the compensating voltages corresponding to various pixel values of each of pixels on the LCD panel can be obtained and preset in the LCD. Naturally, for the LCD panel with the HSD architecture shown in FIG. 3, it is necessary to only test and obtain the values of the compensating voltages for various pixel values of the pixel corresponding to the voltages on data lines having a rising edge or falling edge.

Optionally, the set of the compensating voltages preset in the LCD can also be a set comprising the product of the compensating voltage coefficients of each of pixels multiplied by each of pixel values of the pixel electrodes respectively, wherein the compensating voltage coefficient of each of pixels represents the quotient obtained from the difference value between the theoretical voltage on a data line and the actual voltage on the data line corresponding to a specific pixel value of each of pixels dividing the maximum pixel value of each of pixel.

For example, assuming that a specific pixel value of a pixel is 255 and that the theoretical voltage Vt and the actual voltage Vm on a data line corresponding to the pixel are 5V and 4.4V respectively, the compensating voltage coefficient of the pixel is 0.0024. Assuming that the pixel value of the pixel is 100 at a certain timing and that the actual voltage on the data line is 1.7V, since the compensating voltage on the data line is 0.24V, the compensated voltage on the data line corresponding to the pixel is 1.94V, thus to some extent compensating the voltage on the data line corresponding to the pixel.

Optionally, a specific pixel value in the set of compensating voltages obtained can be any pixel value of a pixel; if the maximum pixel value of the pixel is 255, the specific pixel value can be any pixel value between 0 and 255.

Since the voltage on the data line corresponding to various pixel values of the pixel is non-linear, in order to minimize the deviation between the compensated voltage on the data line from the theoretical voltage on the data line, it is preferred that the specific pixel value is the maximum pixel value of the pixel.

Note that the driving apparatus 50 for the liquid crystal display panel further comprises a gate driving unit, or may further include a timing controller unit and the like. As such units do not belong to the improvements of the driving apparatus for the LCD panel provided in the embodiment of the present invention, detailed descriptions on these units are omitted in the embodiments of the present invention.

Figure 6:
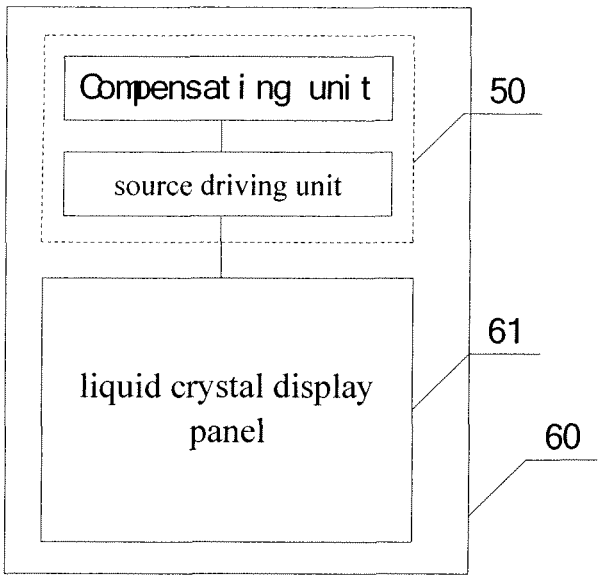
FIG. 6 is a schematic diagram illustrating a structure of a liquid crystal display provided in an embodiment of the present invention.

In an embodiment of the present invention, there is provided a liquid crystal display 60, as shown in FIG. 6, wherein the LCD 60 includes a liquid crystal display panel 61 and the driving apparatus 50 for the liquid crystal display panel described as above, and thus the driving apparatus provided in the embodiment of the present invention can improve the display quality of the LCD, wherein the specific structure of said liquid crystal display is omitted in the embodiment of the present invention.

The skilled in the art can understood: all or part of the steps for realizing the above-mentioned method embodiments can be implemented by the hardware related with instructions in program, wherein the aforementioned program may be stored in a computer readable storage medium; as the program is executed, the steps of the method embodiments are carried out. The storage medium includes: ROM, RAM, disk or CD-ROM, and other media capable of storing program codes.

The above are only specific embodiments of the present invention, and the scope of the present invention is not limited to this; any variations or alternations that any skilled in the art can easily think of in view of the present disclosure are intended to be covered by the protection scope of the present invention. Thus, the protection scope of the invention should be defined by the annexed claims.

What is claimed is:

1. A driving method for a Liquid Crystal Display (LCD) panel, comprising:

compensating a voltage on a data line according to a pixel value of each of pixels on the LCD panel corresponding to an image to be displayed; and inputting the compensated voltage on the data line to the data line, and driving the LCD panel for display;

wherein compensating the voltage on the data line according to the pixel value of each of pixels on the LCD panel corresponding to the image to be displayed comprises:

acquiring the pixel value of each of pixels corresponding to the image to be displayed and an actual voltage supplied to the data line from a source driving unit;

performing compensation according to a set of compensating voltages as preset and the actual voltage on the data line, wherein the set of compensating voltages is a preset set of values of compensating voltages of data lines corresponding to various pixel values of each of pixels on the LCD panel;

wherein the set of compensating voltages is a set comprising a product of compensating voltage coefficient of each of pixels multiplied by each of pixel values of each of pixels respectively, wherein the compensating voltage coefficient of each of pixels represents the quotient obtained from a difference value between a theoretical voltage on the data line and the actual voltage on the data line corresponding to a specific pixel value of each of pixels divided by a maximum pixel value of each of pixel.

2. The driving method of claim 1, wherein the specific pixel value is the maximum pixel value of each of pixels.

3. A driving apparatus for a Liquid Crystal Display (LCD) panel, wherein the driving apparatus comprises a source driving unit and a compensating unit;

the compensating unit being configured to compensate a voltage on a data line according to a pixel value of each of pixels on the LCD panel corresponding to an image to be displayed; and the source driving unit being configured to input the compensated voltage on the data line to the data line, and drive the LCD panel for display;

wherein the compensating unit comprises an acquiring module and a first compensating module;

the acquiring module being configured to acquire the pixel value of each of pixels corresponding to the image to be displayed and an actual voltage supplied to the data line from the source driving unit;

the first compensating module being configured to perform compensation according to a set of compensating voltages as preset and the actual voltage on the data line, wherein the set of compensating voltages is a preset set of values of compensating voltages of data lines corresponding to various pixel values of each of pixels on the LCD panel;

wherein the set of compensating voltages is a set comprising a product of compensating voltage coefficient of each of pixels multiplied by each of pixel values of each of pixels respectively, wherein the compensating voltage coefficient of each of pixels represents the quotient obtained from a difference value between a theoretical voltage on a data line and the actual voltage on the data line corresponding to a specific pixel value of each of pixels divided by a maximum pixel value of each of pixel.

4. The driving apparatus of claim 3, wherein the specific pixel value is the maximum pixel value of each of pixel.

5. A liquid crystal display comprising a liquid crystal display panel and a driving apparatus for the LCD panel, wherein the driving apparatus comprises a source driving unit and a compensating unit and a compensating unit;

the compensating unit being configured to compensate a voltage on a data line according to a pixel value of each of pixels on the LCD panel corresponding to an image to be displayed; and the source driving unit being configured to input the compensated voltage on the data line to the data line, and drive the LCD panel for display;

wherein the compensating unit comprises an acquiring module and a first compensating module;

the acquiring module being configured to acquire the pixel value of each of pixels corresponding to the image to be displayed and an actual voltage supplied to the data line from the source driving unit;

the first compensating module being configured to perform compensation according to a set of compensating voltages as preset and the actual voltage on the data line, wherein the set of compensating voltages is a preset set of values of compensating voltages of data lines corresponding to various pixel values of each of pixels on the LCD panel;

wherein the set of compensating voltages is a set comprising a product of compensating voltage coefficient of each of pixels multiplied by each of pixel values of each of pixels respectively, wherein the compensating voltage coefficient of each of pixels represents the quotient obtained from a difference value between a theoretical voltage on a data line and the actual voltage on the data line corresponding to a specific pixel value of each of pixels divided by a maximum pixel value of each of pixel.

6. The liquid crystal display of claim 5, wherein the specific pixel value is the maximum pixel value of each of pixel.

* * * * *